US011130071B1

(12) United States Patent
Patrick

(10) Patent No.: US 11,130,071 B1
(45) Date of Patent: Sep. 28, 2021

(54) FRISBEE WITH A SINUSOIDAL SHAPE

(71) Applicant: Shark Wheel, Inc.

(72) Inventor: David Michael Patrick, Ladera Ranch, CA (US)

( * ) Notice: Subject to any disclaimer, the term of this patent is extended or adjusted under 35 U.S.C. 154(b) by 143 days.

(21) Appl. No.: 15/873,899

(22) Filed: Jan. 18, 2018

(51) Int. Cl.
*A63H 33/18* (2006.01)

(52) U.S. Cl.
CPC ..... *A63H 33/18* (2013.01)

(58) Field of Classification Search
CPC ..... A63H 33/18
See application file for complete search history.

(56) References Cited

U.S. PATENT DOCUMENTS

D165,649 S * 1/1952 Harrison ..... D21/440
3,852,910 A 12/1974 Everett
4,204,357 A * 5/1980 Harrington ..... A63H 33/18 446/219
4,301,616 A 11/1981 Gudgel
4,307,535 A * 12/1981 Martin ..... A63H 33/18 446/48
4,580,990 A * 4/1986 Avery ..... A63H 33/18 446/220
5,259,802 A 11/1993 Yang
5,340,347 A * 8/1994 Yenerich ..... A63H 33/18 446/48
5,536,195 A * 7/1996 Stamos ..... A63H 33/18 446/219
5,674,101 A * 10/1997 Saloor ..... A63B 65/00 446/46
6,402,342 B1 6/2002 Chiang
6,702,583 B1 * 3/2004 Christ-Janer ..... G09B 19/00 428/3
D564,042 S * 3/2008 Roy ..... D21/443
8,487,468 B2 * 7/2013 Christopher ..... H02K 7/1823 290/54
D775,283 S 12/2016 Parsley
2008/0125001 A1 5/2008 Barniak

* cited by examiner

*Primary Examiner* — Jeffrey S Vanderveen
(74) *Attorney, Agent, or Firm* — Cionca IP Law P.C.; Marin Cionca

(57) ABSTRACT

A frisbee balanced to spin about a central axis has a central portion with a top surface and an opposing bottom surface. The central portion terminates peripherally with a circular rim having a sinusoidal curvature. The central portion conforms to the sinusoidal curvature of the rim forming radial variations of peaks and valleys. Plural sinusoidal cycles of radially directed, convex peaks impart thrust enabling it to float in a chosen direction when thrown and to rotate about its central axis developing lift due to air passing over the generally domed top surface.

5 Claims, 3 Drawing Sheets

FRISBEE WITH A SINUSOIDAL SHAPE

FIELD OF THE DISCLOSURE

The present invention relates to a Frisbee or a flying device, and more particularly to a Frisbee with a marginal edge contoured sinusoidally for improving the flying effect of the Frisbee and for increasing its flying distance.

DESCRIPTION OF THE PRIOR ART

Typical Frisbees or hand flung flying devices have a convex top surface surrounded by a downwardly curved marginal rim terminating with a circular edge. For example, U.S. Pat. No. 4,301,616 to Gudgel discloses one of the typical illuminated Frisbee toys of the flying saucer type, to be thrown through the air from one player to another. U.S. Pat. No. 5,259,802 to Yang, and U.S. Pat. No. 6,402,342 to Chiang disclose two further typical Frisbees or flying devices to be thrown from one individual to another as a game or to be thrown toward a basket in a field game known as Frisbee Golf. However, similarly, these typical Frisbees fail to have advanced aerodynamic shapes to increase their flying distance. The presently described and illustrated novel frisbee invention has greater stability in flight and flies greater distances relative to standard or common frisbees.

SUMMARY OF THE INVENTION

Frisbee Aerodynamics:

A standard frisbee has a circular curved top surface surrounded by a downwardly curved rim. The primary purpose of the rim is to force air flow over the top surface where, by the Bernoulli principle low air pressure is created causing lift. A slight upward tilt (angle of attack) of the frisbee causes air to be deflected downward which causes a further upward force on the frisbee. A spinning frisbee has gyroscopic inertia which gives the frisbee stability so that it moves through the air while maintaining a generally horizontal attitude. The primary objective of the present invention is to provide a frisbee with advanced aerodynamic characteristics so that when manually thrown with a spin and upward tilt, it experiences greater lift and stability as compared to a standard frisbee thrown with the same initial projecting force and spin. A further objective of the invention is to provide a frisbee with a top portion joined peripherally with a downwardly directed rim which terminates in a circular peripheral edge. A further objective of the invention is to provide a frisbee which, when viewed from a side, appears to have a sinusoidal curvature. A further objective is to have the top surface contiguous with the rim, so that the top surface also has a continuous sinusoidal unbroken shape. A further objective is to provide such a shape as to derive higher pressure air pockets below the frisbee to generate greater lift. A further objective is to provide a frisbee that remains horizontal in flight rather than tilting to one side or the other. A further objective is to provide a frisbee that has a rim with a curvature that enabling hand-wrist positioning when throwing the frisbee to be in a more natural attitude. A further objective is to provide a frisbee that is easier to pick up when it lays on a flat surface due to raised portions of its rim. This also has the advantage of preventing portions of the rim from being scuffed when the frisbee slides along the ground. The latter benefit leads to a longer useful life of the frisbee.

Further objectives and advantages of the present invention will become apparent from a careful reading of the detailed description provided herein, with appropriate reference to the accompanying drawings.

DETAILED DESCRIPTION OF THE PREFERRED EMBODIMENTS

Figure 1:
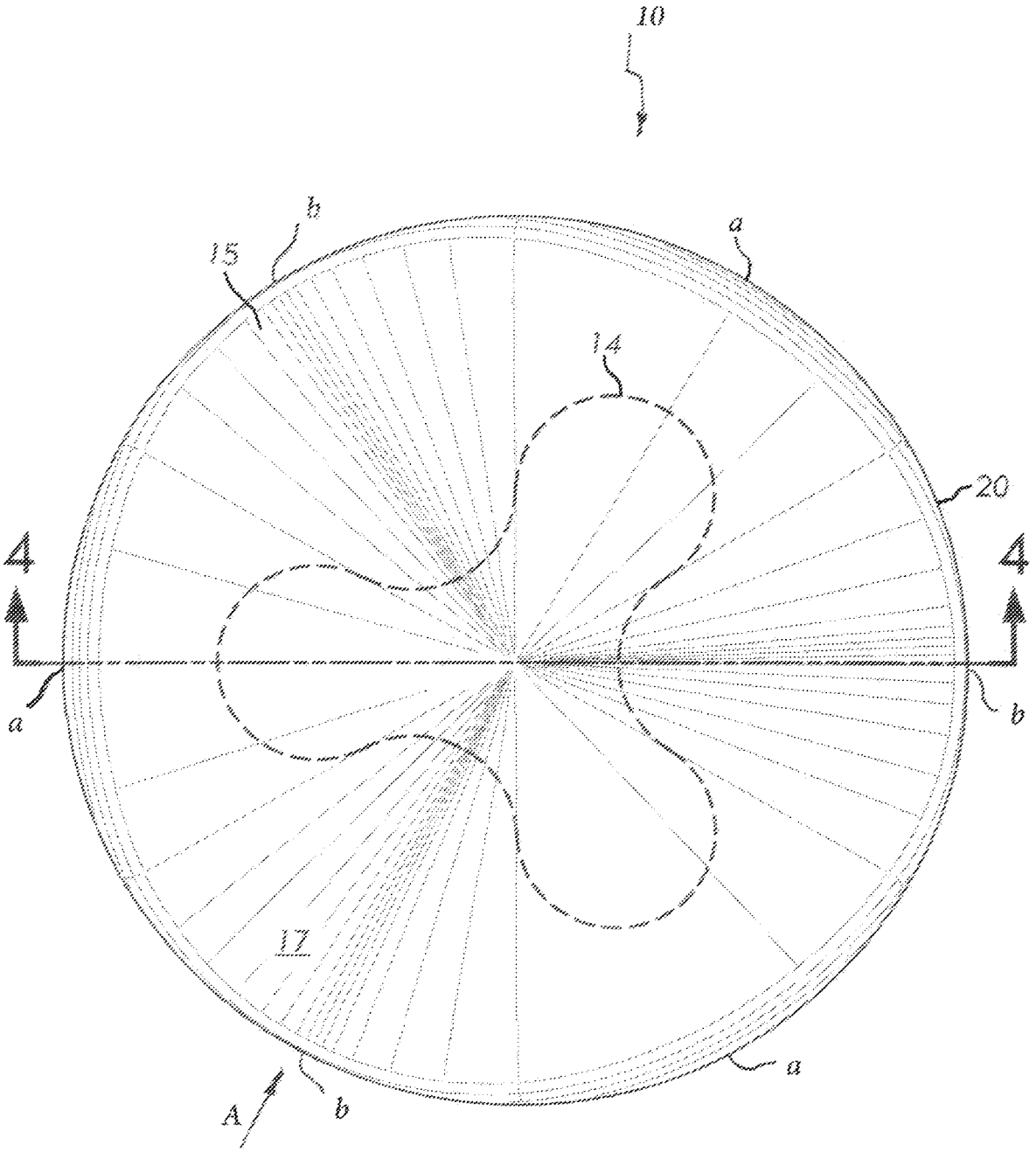
FIG. 1 is a top plan view of the presently described frisbee.
Figure 2:
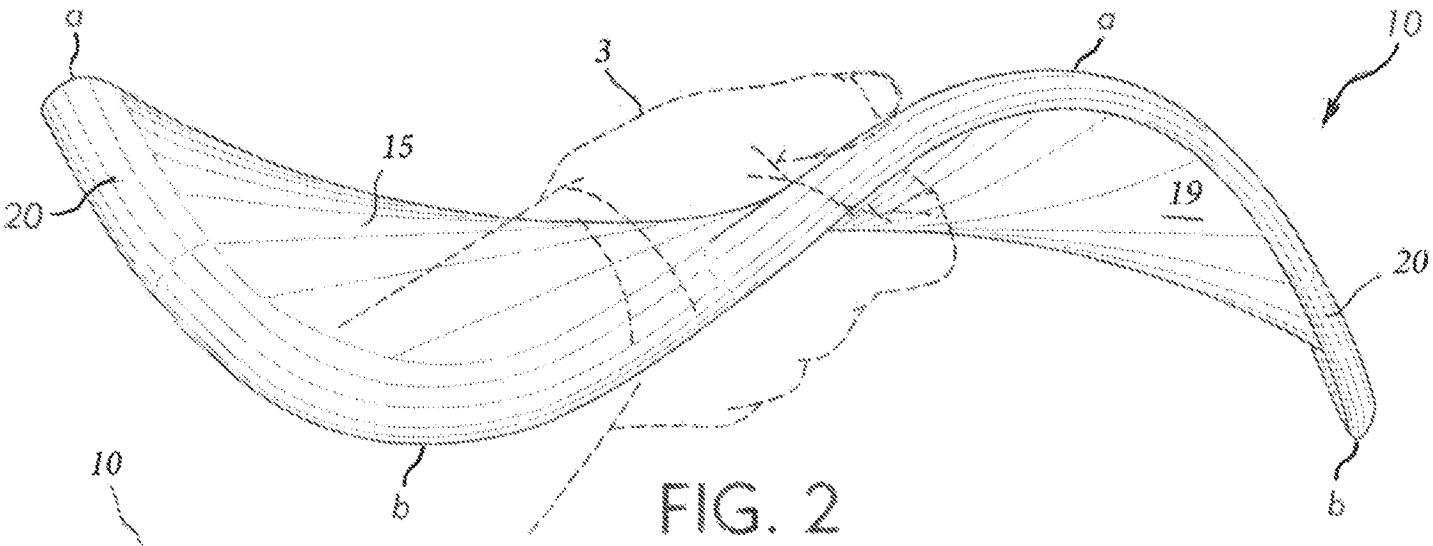
FIG. 2 is a side elevation view thereof showing how a hand might grasp the frisbee.
Figure 3:
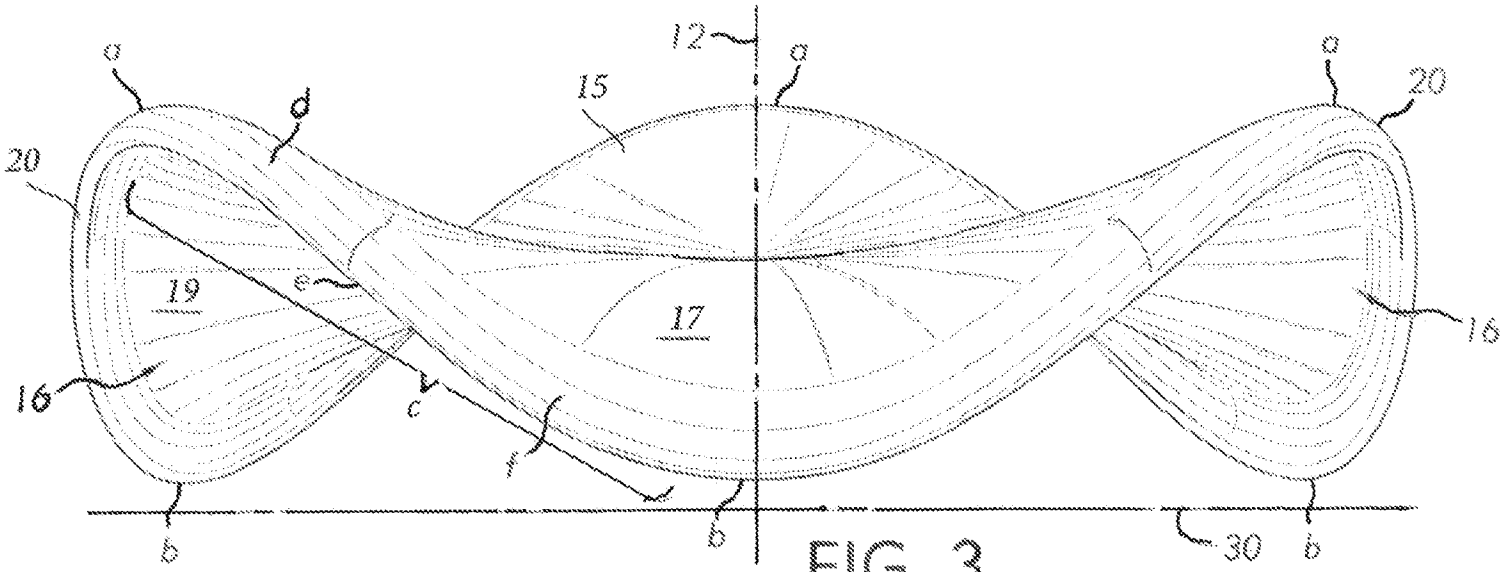
FIG. 3 is a further side elevation view thereof as viewed along arrow "A" in FIG. 1.
Figure 4:
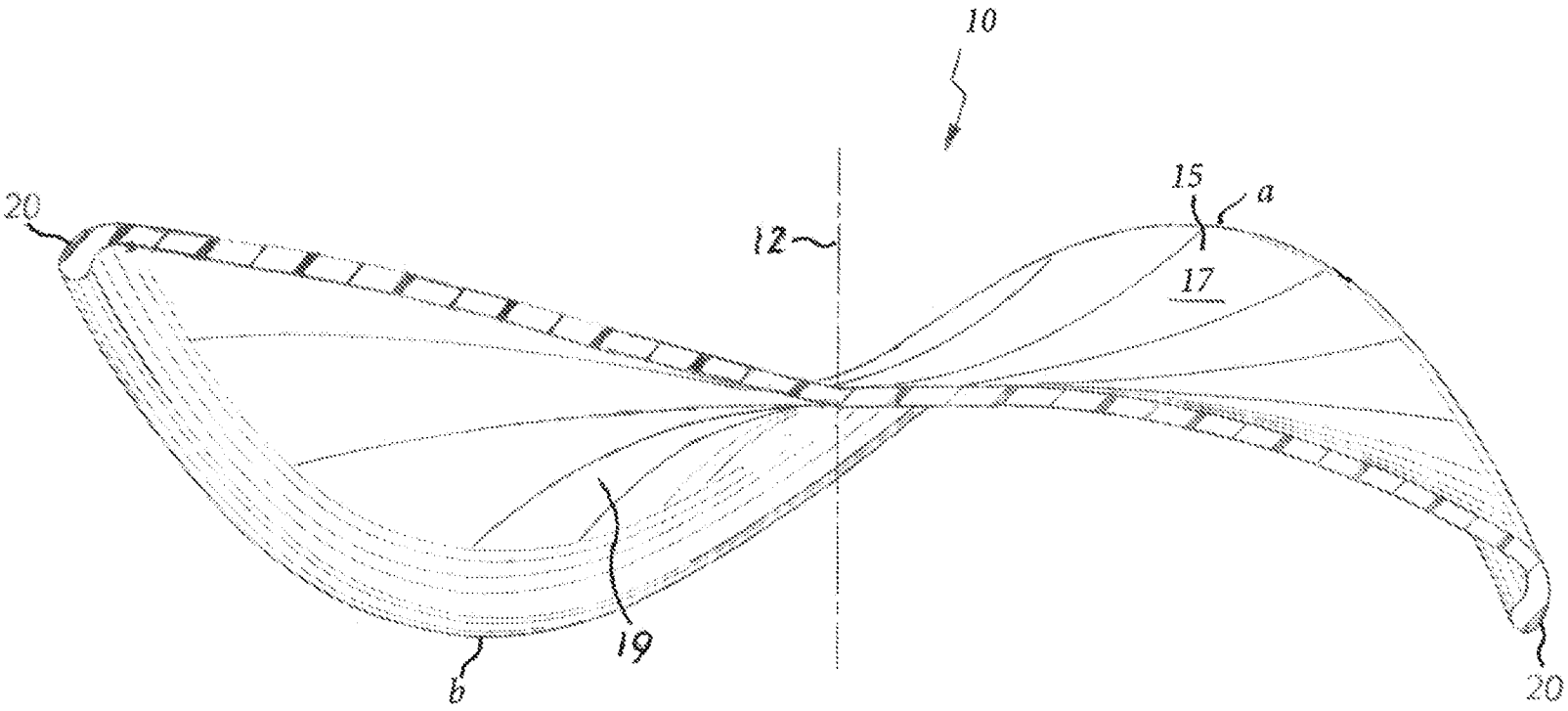
FIG. 4 is a cross-section view thereof taken at cutting plane 4-4 of FIG. 1.

The invention is a sinusoidally shaped frisbee 10, which is illustrated in FIGS. 1-4 attached hereto. Frisbee 10 may be constructed from plastic or other materials that are relatively light in weight and yet rigid in use. FIG. 1 shows that frisbee 10 is circular in overall shape and that it has a central portion 15 with a top surface 17. An opposing bottom surface 19 can be see in FIGS. 2-4. Central portion 15 terminates peripherally at a rim 20 which follows a sinusoidal curve as best seen in FIGS. 2-4. Central portion 15 smoothly conforms to the sinusoidal curvature of rim 20 as can be seen in the figures and therefore has peaks and valleys. In FIG. 1 these peaks and valleys are indicated by radial contour lines wherein when shown close together they represent concave valleys in top surface 17, and when shown spaced further apart represent convex peaks in top surface 17. As illustrated, a central dashed pattern 14 having three peaks separated by three valleys is a reference contour pattern representative of the convex peaks and the concave valleys of top surface 17.

The contour lines shown in FIG. 1, indicate that frisbee 10 has three sinusoidal cycles which conform to a conventional sinusoidal variations along rim 20 as well as across central portion 15. It should be understood that in alternate embodiments frisbee 10 may be formed with more or fewer than three sinusoidal cycles, as for instance: two, four, five, six or more. In such alternate embodiments sinusoidal peaks and valleys of rim 20 and central portion 15 may occur closer together or further apart.

FIG. 2 illustrates, in dashed line outline, a person's hand 3 holding frisbee 10 in preparation for throwing it. It should be noticed that hand 3 is able to be held in a natural attitude, that is, it does not require the wrist to be cocked as with a standard frisbee. This is a significant advantage and is enabled by the shape of frisbee 10. When tossed, frisbee 10 will be given an initial velocity in a selected direction and simultaneously a rotational velocity about its central axis 12 shown in FIG. 3. Frisbee 10 will be tossed with a slight upward angle at its leading edge, providing an angle of attack. Frisbee 10 is thrown horizontally as indicated by horizontal line 30 in FIG. 3. As with all frisbees, when frisbee 10 is tossed with a wrist action to impart a spin about central vertical axis 12 and in a horizontal attitude it will move with a floating action through the air in a straight line.

Now in further reference to FIG. 3, it is shown, as said, that peripheral rim 20 has a sinusoidal contour. In this respect, several points on rim 20 are of interest. For instance, at points "a" rim 20 reaches relative positive sinusoidal peaks. At points "b" rim 20 reaches the center of relative negative sinusoidal valleys. In each instance, between points "a" and "b" the contour of rim 20 is a smooth sinusoidal curve "c" moving along a convex upward portion "d", through an inflection point "e", and into a concave down portion "f". This same shape occurs between each relative positive peak "a" and its next adjacent negative valley "b" around the perimeter of frisbee 10.

FIGS. 2-4 show that central portion 15 follows the sinusoidal curvature of rim 20. Cutting plane line 4-4 in FIG. 1 shows that central portion 15 has a peak which extends radially from rim 20 on the left to central axis of rotation 12 and then follows into a valley on the right terminating at rim 20. The cut edge of FIG. 4 shows this contour clearly and also shows the relative thickness of central portion 15 and a thicker rim 20.

As discussed, we know that frisbee 10 will float along a path through the air in a direction when propelled by a manual thrust. We know, too, that the manual thrust can impart rotation to frisbee 10. Therefore, as discussed in "Frisbee Aerodynamics" above, frisbee 10 will acquire Bernoulli principle lift due to the overall generally curved central portion 15. Angle of attack lift will add as well to the overall lift of frisbee 10. Gyroscopic inertia will provide stability.

In addition to the standard aerodynamic characteristics of conventional frisbees, frisbee 10 develops additional lift due to the combination of the radial sinusoidal convex peaks in top surface 17 in combination with frisbee rotation. This provides additional Bernoulli principle lift due to the fact that as frisbee 10 rotates, air moving over the sinusoidal peaks in central portion 15 causes air pressure to drop. A still further factor that develops additional lift comes about due to the fact that the sinusoidal curvature of rim 20 has open "scoops" 16 (FIG. 3) which function to force air by ram-action into the interior of frisbee 10 due to its rotation. This slightly increases the air pressure below central portion 15 relative to the pressure above. Due to these additional lift factors, frisbee 10 tends to float longer and therefore, travels over a longer distance than a standard frisbee tossed with comparable trust and rotation.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

What is claimed is:

1. A frisbee comprising:

a central axis of rotation;

a central portion having a top surface and an opposing bottom surface, said central portion terminating peripherally with a circular rim, and a sinusoidal curvature formed by said rim having negative sinusoidal valleys and positive sinusoidal peaks and said central portion conforming to said negative valleys and positive peaks of the rim at an upper edge of said rim, by having a surface peak extending radially from each one of the positive sinusoidal peaks to the central axis of rotation, following into a surface valley terminating at each one of the negative sinusoidal valleys of the rim;

wherein each one of the surface peaks of the central portion do not extend vertically past the positive sinusoidal peaks of the rim, and each one of the surface valleys of the central portion do not extend vertically past the negative sinusoidal valleys of the rim.

2. The frisbee of claim 1 wherein said circular rim has plural sinusoidal cycles.

3. The frisbee of claim 2 wherein the sinusoidal peaks occur at equally spaced-apart positions on said rim, wherein each one of said sinusoidal valleys is centered between each adjacent pair of said sinusoidal peaks, and wherein said central portion is sinusoidally curved in relation to said sinusoidal peaks and sinusoidal valleys.

4. The frisbee of claim 1 wherein said frisbee is balanced to spin about the central axis of rotation.

5. The frisbee of claim 1, wherein said circular rim is thicker relative to said central portion.

* * * * *